US005249628A

United States Patent [19]

Surjaatmadja

[11] Patent Number: 5,249,628

[45] Date of Patent: Oct. 5, 1993

[54] HORIZONTAL WELL COMPLETIONS

[75] Inventor: Jim B. Surjaatmadja, Duncan, Okla.

[73] Assignee: Halliburton Company, Duncan, Okla.

[21] Appl. No.: 953,671

[22] Filed: Sep. 29, 1992

[51] Int. Cl.[5] ..... E21B 43/00

[52] U.S. Cl. ..... 166/308

[58] Field of Search ..... 166/297, 298, 299, 308, 166/305.1, 311, 312

[56] References Cited

U.S. PATENT DOCUMENTS

| | | | |
|---|---|---|---|
| 4,850,431 | 7/1989 | Austin et al. | 166/308 |
| 4,949,788 | 8/1990 | Szarka et al. | 166/285 |
| 4,979,561 | 12/1990 | Szarka | 166/240 |
| 4,991,653 | 2/1991 | Schwegman | 166/312 |
| 4,991,654 | 2/1991 | Brandell et al. | 166/332 |
| 5,029,644 | 7/1991 | Szarka et al. | 166/223 |
| 5,133,410 | 7/1992 | Gadelle et al. | 166/308 |

*Primary Examiner*—Thuy M. Bui

*Attorney, Agent, or Firm*—James R. Duzan; L. Wayne Beavers

[57] ABSTRACT

Casing slip joints are provided on opposite sides of a fracture initiation location to accommodate casing and formation movement during fracturing of a well. In another aspect of the invention, the fracture initiation location is provided by forming openings through the well casing and then forming fan-shaped slots in the formation surrounding the casing. Those slots are formed by a hydraulic jet which is directed through the opening and then pivoted generally about the point of the opening. These fan-shaped slots circumscribe an angle about the axis of the casing substantially greater than the angle circumscribed by the opening itself through which the slot was formed. These techniques are particularly applicable to fracturing of horizontal wells.

32 Claims, 5 Drawing Sheets

HORIZONTAL WELL COMPLETIONS

BACKGROUND OF THE INVENTION

1. Field of the Invention

The present invention relates generally to the completion of oil and gas wells through fracturing operations, and more particularly, but not by way of limitation, to the completion of substantially deviated or horizontal wells.

2. Description of the Prior Art

Several different techniques are currently used for the completion of horizontal wells.

A first, very common manner of completing a horizontal well is to case and cement the vertical portion of the well and to leave the horizontal portion of the well which runs through the producing formation as an open hole, i.e., that is without any casing in place therein. Hydrocarbon fluids in the formation are produced into the open hole and then through the casing in the vertical portion of the well.

A second technique which is commonly used for the completion of horizontal wells is to place a length of slotted casing in the horizontal portion of the well. The purpose of the slotted casing is to present the open hole from collapsing. A gravel pack may be placed around the slotted casing. The slotted casing may run for extended lengths through the formation, for example as long as one mile.

A third technique which is sometimes used to complete horizontal wells is to cement casing in both the vertical and horizontal portions of the well and then to provide communication between the horizontal portion of the casing and the producing formation by means of perforations or casing valves. The formation may also be fractured by creating fractures initiating at the location of the perforations or the casing valves.

In this third technique, the formation of perforations is often done through use of explosive charges which are carried by a perforating gun. The explosive charges create holes which penetrate the side wall of the casing and penetrate the cement surrounding the casing. Typically, the holes will be in a pattern extending over a substantial length of the casing.

When the communication between the casing and the producing formation is provided by casing valves, those valves may be like those seen in U.S. Pat. No. 4,949,788 to Szarka et al., U.S. Pat. No. 4,979,561 to Szarka, U.S. Pat. No. 4,991,653 to Schwegman, U.S. Pat. No. 5,029,644 to Szarka et al., and U.S. Pat. No. 4,991,654 to Brandell et al., all assigned to the assignee of the present invention. Such casing valves also provide a large number of radial bore type openings communicating the casing bore with the surrounding formation.

When utilizing either perforated casing or casing valves like those just described, the fracturing fluid enters the formation through a large multitude of small radial bores at a variety of longitudinal positions along the casing and there is no accurate control over where the fracture will initiate and in what direction the fracture will initiate.

In the context of substantially deviated or horizontal wells, the cementing of casing into the horizontal portion of the well followed by subsequent fracture treatments has not been as successful as desired when using existing techniques, especially when multiple zone fracturing is involved.

SUMMARY OF THE INVENTION

I have determined that one of the reasons fracturing of horizontal wells has not been completely satisfactory in the past is that when a fracture radiates outward in a plane transverse to and preferably perpendicular to the longitudinal axis of the casing, the subsurface formation tends to move on either side of the fracture in a direction generally parallel to the longitudinal axis of the casing, but the casing itself cannot move. Thus, the relative movement between the subsurface formation and the casing often causes a destruction of the bond between the casing and the surrounding cement. This destruction of the cement/casing bond may extend for large distances thus providing a path of communication between adjacent subsurface formations which are to be fractured.

I have developed an improved fracturing technique which eliminates this problem. This is accomplished by providing casing slip joints adjacent the location where the fracture is to be initiated. Preferably, such casing slip joints are provided on both sides of the fracture initiation location. The casing slip joints allow the casing to move with the expanding formation when fracturing occurs. This aids in preventing a destruction of the bond between the cement and the casing. Preferably, the use of casing slip joints is accompanied by the provision of a means for directing the initial direction of fracture initiation so that the fracture initiates in a plane generally perpendicular to the longitudinal axis of the casing.

I have determined that another reason fracturing of horizontal wells has not been completely satisfactory in the past is that the stresses which are created within the formation immediately surrounding the casing and cement in a horizontal well are such that quite often the fracture will not radiate outward in a plane perpendicular to the axis of the well as is most desirable, but instead quite often the fracture will run parallel to the casing and thus will allow communication between adjacent formations.

I have developed an improved method for initially communicating the casing bore with the surrounding formation so as to provide a predetermined point of initiation of the fracture and so as to provide directional guidance to the fracture when it is initiated.

This method is accomplished by inserting a hydraulic jetting tool into the casing. One or more openings are formed through the casing, and preferably those openings are formed by the hydraulic jetting tool itself.

The hydraulic jetting tool is then used to direct a hydraulic jet through the opening in the casing and the jetting tool is pivoted so as to cut one or more fan-shaped slots in the surrounding formation in a plane transverse to the longitudinal axis of the casing. Each of these fan-shaped slots circumscribes a substantially larger arc about the axis of the casing than does the opening through which the slot was cut.

Preferably these fan-shaped slots lie in a plane substantially perpendicular to the longitudinal axis of the casing.

Subsequently, when fracturing fluid is applied under pressure to the fan-shaped slots, the fracture will initiate in the plane of the fan-shaped slots and will at least initially radiate outward from the well bore along that plane. This will occur regardless of the orientation of the natural least principal stress axis within the surrounding formation.

The provision of the fan-shaped slots will allow initiation of the fracture and allow it to move outward away from the wellbore sufficiently so that the direction of the fracture will not be controlled by the local stresses immediately surrounding the casing and wellbore which might otherwise cause the fracture to follow the wellbore.

Numerous objects, features and advantages of the present invention will readily apparent to those skilled in the art upon a reading of the following disclosure when taken in conjunction with the accompanying drawings.

BRIEF DESCRIPTION OF THE DRAWINGS

FIG. 8 is a view similar to FIG. 1 illustrating the use of the invention in combination with slotted casing in an open borehole in parts of the horizontal portion of the well.

DETAILED DESCRIPTION OF THE PREFERRED EMBODIMENTS

Figures 1, 2, 2A:
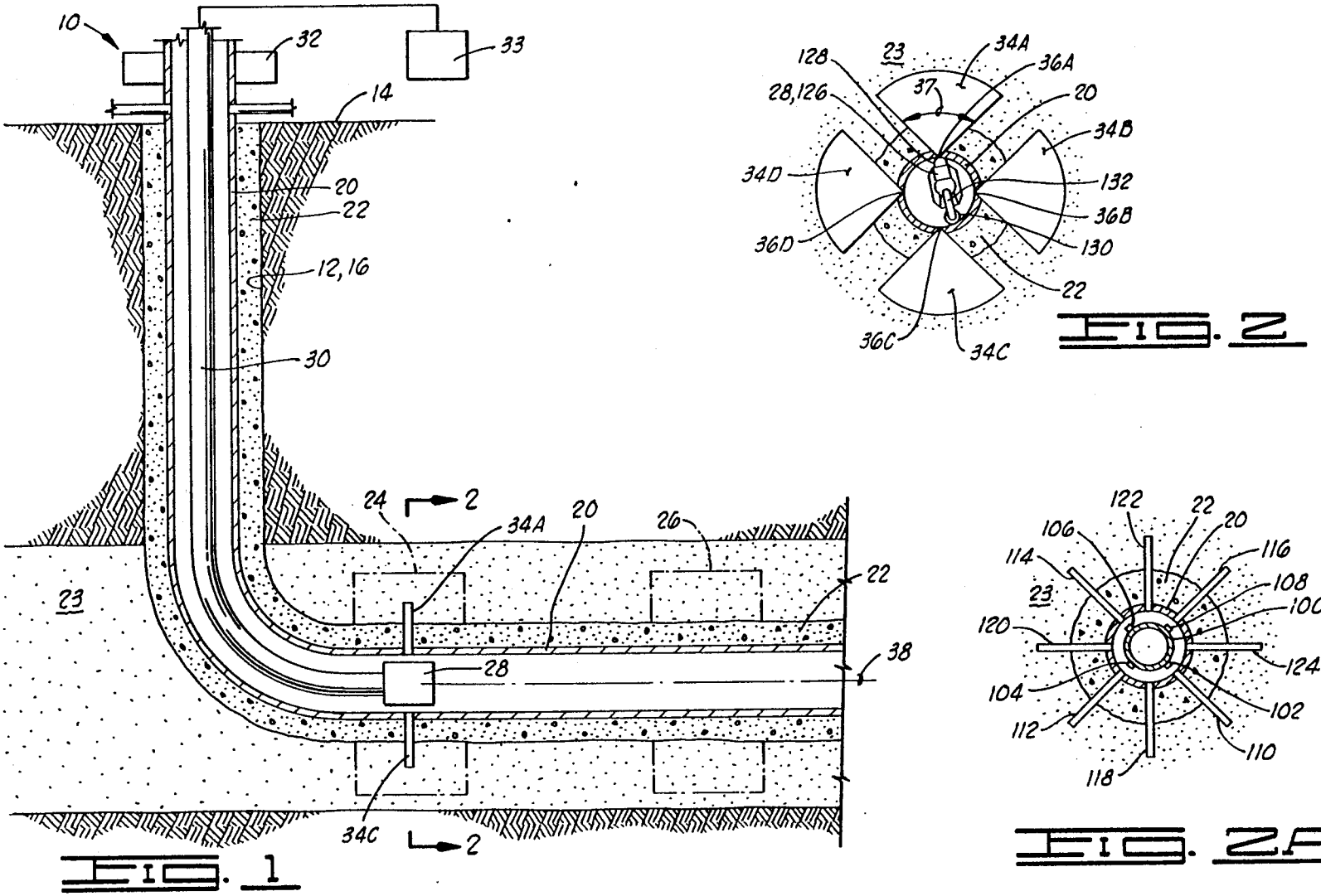
FIG. 1 is an elevation schematic sectioned view of a well having a horizontal portion which has been cased and cemented. The formation is shown as having had radially extending fan-shaped slots cut therein.
FIG. 2 is a schematic view taken along line 2—2 of FIG. 1 in a plane perpendicular to the longitudinal axis of the wellbore showing four fan-shaped slots surrounding the casing.
FIG. 2A is a view similar to FIG. 2, showing a pattern of eight radially extending bores located in a common plane perpendicular to the axis of the wellbore.

Referring now to the drawings, and particularly to FIG. 1, a well is shown and generally designated by the numeral 10. The well is formed by a wellbore 12 which extends downward from the earth's surface 14. The wellbore 12 has an initial, generally vertical portion 16 and a lower, generally horizontal portion 18.

The well 10 includes a casing string 20 which is located within the wellbore 12 and cemented in place therein by cement 22.

The horizontal portion 18 of wellbore 12 is shown as intersecting a subterranean formation 23 in which are located two imaginary zones which are to be fractured. The zones are outlined in phantom lines and are generally designated by the numerals 24 and 26.

A hydraulic jetting tool schematically illustrated and designated by the numeral 28 has been lowered into the casing 20 on a tubing string 30. A conventional wellhead 32 is located at the upper end of the well at the earth's surface.

A source of high pressure fluid 33 is connected to the tubing string 30 to provide hydraulic fluid under high pressure to the hydraulic jetting tool 28.

In the first zone 24, two fan-shaped slots 34A and 34C are shown in cross section extending through the cement 22 into the surrounding zone 24. The slots have been cut by the hydraulic jetting tool 28 in a manner further described below.

FIG. 2 is a cross-sectional view taken along line 2—2 of FIG. 1 and showing a preferred pattern of fan-shaped slots including four fan-shaped slots 34A, 34B, 34C and 34D.

As seen in FIG. 2, there is associated with each of the fan-shaped slots 34A, 34B, 34C and 34D an opening 36 formed through the casing 20. These openings are designated by the numerals 36A, 36B, 36C and 36D, respectively.

The fan-shaped slots 34 are shown as lying in a plane substantially perpendicular to a longitudinal axis 38 of the horizontal portion of the casing 20.

In FIG. 2, the hydraulic jetting tool 28 is shown in position for formation of the opening 36A and radial fan-shaped slot 34A.

Preferably, the opening 36A is formed through the casing 20 by the hydraulic jetting action of jetting tool 28. Then, using the opening 36A as a base or pivot point, the hydraulic jetting tool 28 is rotated back and forth through an arc corresponding to an angle 37 formed by the fan-shaped slot about the point of the opening 36A so that the hydraulic jet which shoots through the opening 36A will cut the fan-shaped slot 34A.

As is apparent in FIG. 2, the fan-shaped slot 34A circumscribes a substantially larger arc about the axis 38 of casing 20 than does the small opening 36A through which the fan-shaped slot 34A was cut.

In its broadest terms, the fan-shaped slot concept does not require that the pivotal base of the slot 34 be located at the opening 36. It is required, however, that the slots be formed in a manner such that the structural integrity of the casing is maintained.

Although it is preferred to form the openings 36 by the hydraulic jetting action just described, it is also within the scope of the present invention to use preformed holes, such as those which would be provided by a casing valve like that shown in Brandell et al., U.S. Pat. No. 4,991,654, in which case the jetting tool 28 would be located adjacent an existing hole provided in the casing valve and the fan-shaped slots would be cut through the existing holes of the casing valve.

It is also within the scope of the present invention to cut the fan-shaped slots 34 in planes other than planes perpendicular to the longitudinal axis 38. Also, the fan-shaped slots may be cut in a vertical portion rather than a horizontal portion of the well.

Furthermore, it is possible to cut the fan-shaped slots 34 to modify the well 10 for reasons other than fracturing the well. For example, the fan-shaped slots 34 may be utilized as a substitute for perforations communicating the casing bore with the surrounding formation.

By forming the fan-shaped slots 34 as shown in FIG. 2 wherein each slot 34 circumscribes a substantially larger arc about the longitudinal axis 38 than does the opening 36 through which the slot is formed, the integrity of the casing, i.e., the structural strength of the casing, is maintained.

Figure 3:
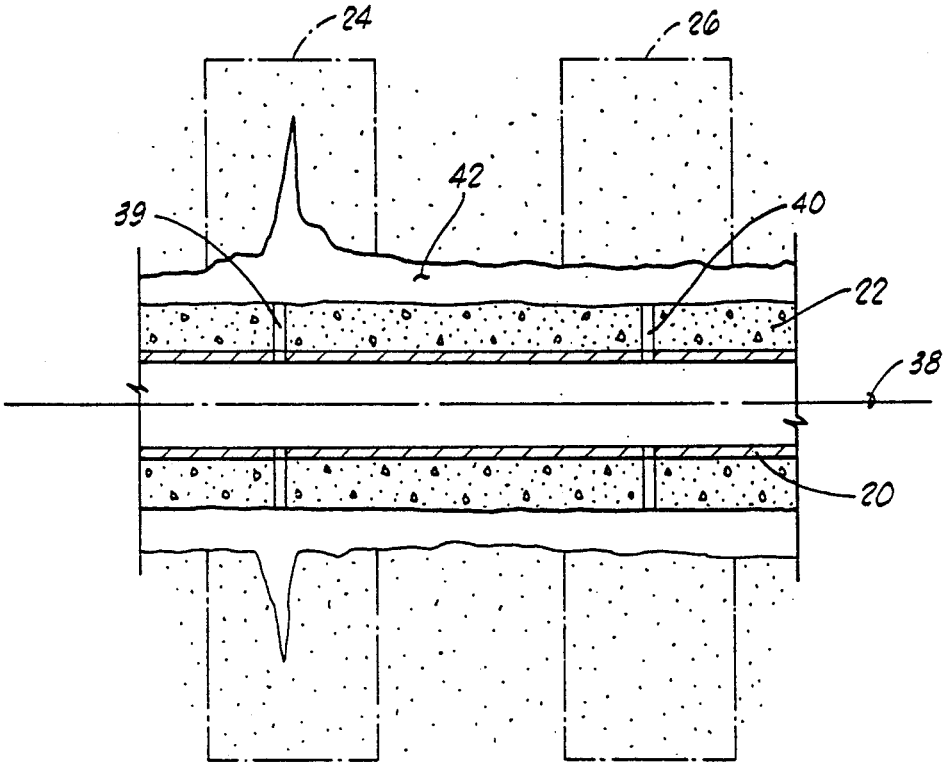
FIG. 3 (PRIOR ART)
FIG. 3 is a schematic illustration of the problem present in the prior art when multiple zones of a horizontal well are fractured, with the fracture propagating parallel to the wellbore so that the zones communicate with each other.

FIG. 3 illustrates a problem which occurs with prior art fracturing techniques for horizontal wells. It will be appreciated that FIG. 3 is a very schematic illustration. FIG. 3 generally shows the well casing 20 cemented in place within the wellbore 12 by cement 22.

Two subsurface zones to be fractured, such as zones 24 and 26 are illustrated. The location of openings such as perforations, casing valves or the like at locations adjacent zones 24 and 26 are schematically illustrated by the openings 39 and 40, respectively. The openings 39 and 40 are only schematically representative of some type of communication between the casing bore and the zones 24 and 26, respectively, which is present prior to the fracturing of the well.

I have determined that one problem which often occurs when fracturing horizontal wells is that, when the fracture is initiated, the fracture will propagate generally parallel to the longitudinal axis 38 of the casing 20. This occurs due to the local stresses immediately surrounding the casing 20 and cement 22, and often it occurs around the cement/formation bond, and thus will create a fracture space generally designated at 42 which generally follows the wellbore and may in fact provide communication between the two subsurface zones 24 and 26. Thus even if individual fracturing jobs are performed on the two zones 24 and 26, if a path of communication is formed between those zones, it may be that one or both of the zones will not be satisfactorily fractured, and of course individual production from the zones will not be possible. When the second zone is being fractured, as soon as the fracture space 42 communicates with another previously opened or fractured area, typically fracture growth will cease because the surface pump supplying the fracturing fluid will typically not have sufficient fluid flow to maintain fracturing pressures once the fracture is opened to a large, previously opened zone.

Figure 4:
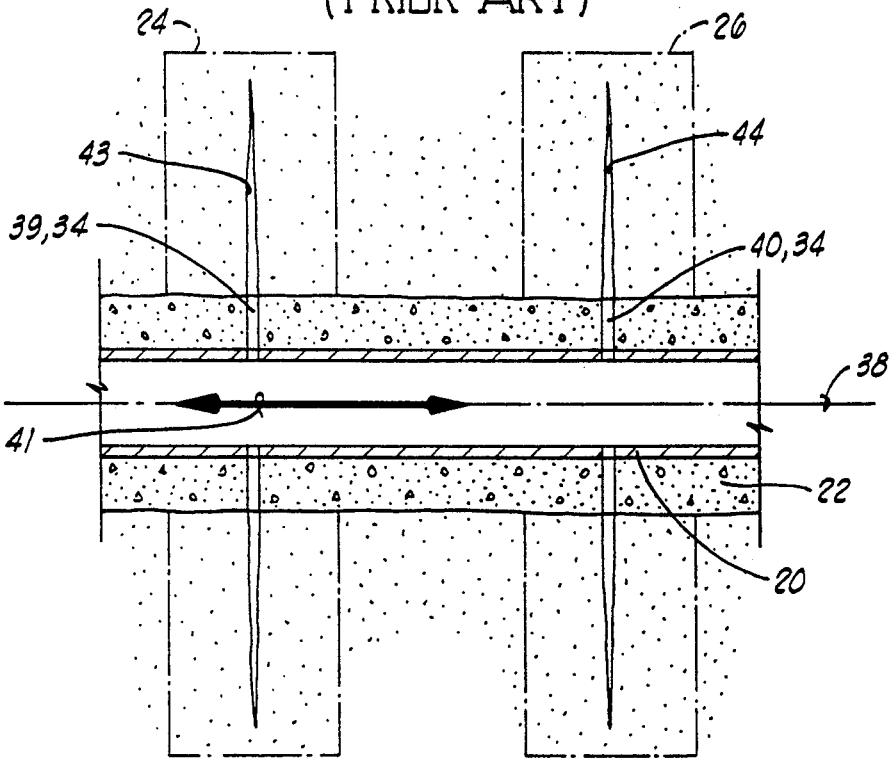
FIG. 4 is a schematic illustration of the manner in which fractures will propagate from the well utilizing the fan-shaped slots of the present invention when the least principal stress of the surrounding formation lies generally parallel to the longitudinal axis of the wellbore.
Figure 5:
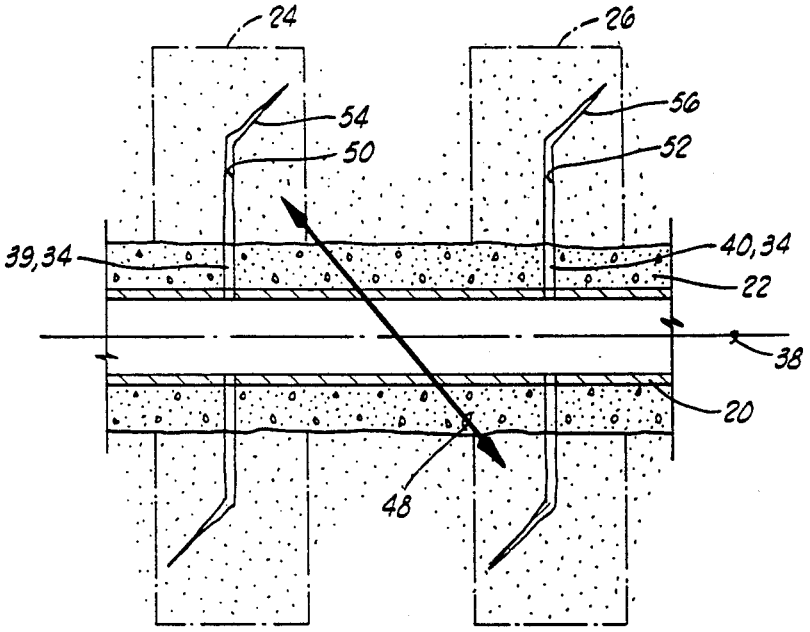
FIG. 5 is a view similar to FIG. 4 showing the manner in which fractures will propagate from the well utilizing the fan-shaped slots of the present invention when the least principal stress of the surrounding formation lies at an angle substantially transverse to the longitudinal axis of the wellbore. The fractures initially propagate outward in a plane perpendicular to the wellbore and then turn in a direction perpendicular to the least principal stress in the surrounding formation.

This problem is avoided by the use of the fan-shaped slots previously described as is schematically illustrated in FIGS. 4 and 5.

FIG. 4 schematically illustrates the situation which will occur when utilizing the methods of the present invention, when the least principal stress axis 41 naturally present in the surrounding formations lies generally parallel to the longitudinal axis 38 of the casing 20. If the openings generally represented at 39 and 40 are formed utilizing the fan-shaped slots illustrated in FIGS. and 2, then the resulting fractures 43 and 44, respectively, will initiate in the plane of the fan-shaped slots 34 and will continue to radiate radially outward in generally that same plane as illustrated in FIG. 4. There will be no intercommunication between the zones 24 and 26 and each zone will be fractured in the desired manner.

FIG. 5 similarly illustrates what will happen when the least principal stress axis 48 is transverse to the longitudinal axis 38.

Again, the fractures will initiate and initially propagate outward in radial planes as indicated at 50 and 52, and will then turn in a direction generally perpendicular to the least principal stress axis 48 as indicated at 54 and 56, respectively.

Thus, in both of the cases shown in FIGS. 4 and 5, the fracture will initiate in the plane defined by the fan-shaped slots and will initially propagate a sufficient distance outward away from the casing 20 so that the local stresses around the casing 20 will not determine the ultimate direction of propagation of the fracture. The ultimate direction of propagation of the fracture will be determined by the least principal stress axis 41 or 48 present in the surrounding formation.

The fan-shaped slots 34 can be described as creating a localized least principal stress axis or direction in the formation substantially parallel to the longitudinal axis 38 thereby aiding subsequent fracture initiation in a plane generally perpendicular to the longitudinal axis 38.

The well 10 has been described herein as a substantially deviated well or horizontal well. It will be appreciated that the well need not be exactly horizontal to benefit from the present invention. Furthermore, even some substantially vertical wells may in some cases benefit from the use of the present invention. As used herein, the term highly deviated or substantially deviated well generally refers to a well the axis of which is deviated greater than 45° from a vertical direction.

THE USE OF CASING SLIP JOINTS IN FIG. 6

Figure 6:
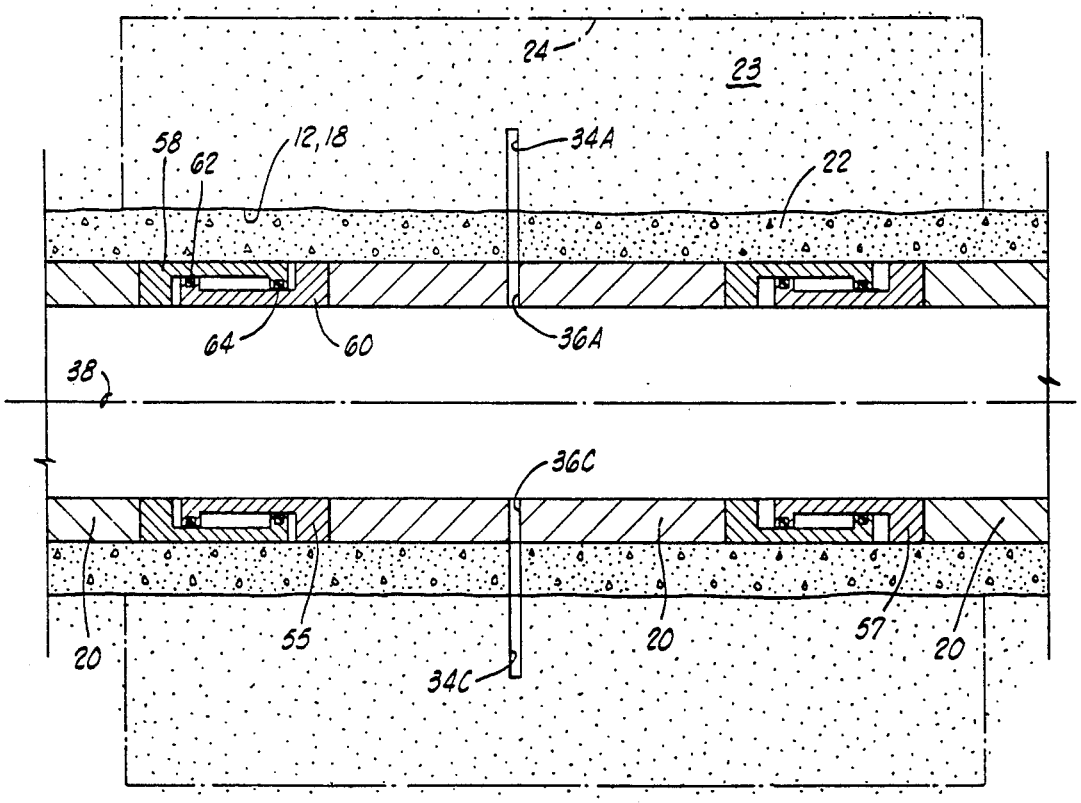
FIG. 6 is a schematic sectioned view of a portion of a horizontal well having casing slip joints located in the casing on opposite sides of the location of the fan-shaped slots.

FIG. 6 illustrates another aspect of the present invention, which improves the success of fracturing operations on horizontal wells by the use of casing slip joints.

The preferred orientation of fractures radiating outward from a horizontal well are generally like those described above with regard to FIGS. 4 and 5. One additional problem that occurs, however, particularly in connection with horizontal wells, is that when the fracture radiates outward in a plane perpendicular to the axis 38 of the well, this causes the surrounding rock formation to move in a direction parallel to the axis 38 of the well. Referring for example to the fracture 43 seen in FIG. 4, that portion of the formation to the right of the fracture 43 would move to the right, and that portion of the formation to the left of fracture 43 would move to the left relatively speaking. The casing 20, however, can not move in either direction, and it cannot stretch sufficiently to accommodate the movement of the surrounding formation. Thus, the movement of the surrounding formation relative to the casing may cause the bond between the cement 22 and the casing 20 to break down. This is particularly a problem when the fracturing of multiple subsurface zones is involved, since this breakdown of the cement-to-casing bond will allow a path of communication between multiple zones which were intended to be isolated from each other by the cement.

The formation and cement will attempt to move relative to the casing 20. Since the cement generally has low shear strength of about 300 psi and a modulus of elasticity of about 1,000,000 psi, it can be predicted that the bond between the cement and casing will fail. The length of such a failure can be predicted by the following formula:

$$L = FW \times E/S$$

Where FW is the maximum fracture width during pumping, E is the modulus of elasticity, and S is the shear strength of the cement bond. In a typical situation, the destruction length, that is, the length over which the casing/cement bond is destroyed, can exceed 800 feet. This can become a major cause of zone communication and will make fracturing treatments of closely spaced zones less effective. I have determined, therefore, that it is important to provide a means whereby this breakdown of the cement/casing bond will not occur.

In FIG. 6, first and second casing slip joints 55 and 57 are provided on opposite sides of the fan-shaped slots 34. Then, when fracturing fluid is pumped into the fan-shaped slots 34 to create and propagate a fracture like fracture 43 seen in FIG. 4, the slip joints 55 and 57 will allow movement of the casing 20 on opposite sides of the fracture along with the surrounding formation thus preventing the destruction of the bond between the casing 20 and cement 22 surrounding the casing during the fracturing operation.

The casing slip joints 55 and 57 are schematically illustrated in FIG. 6. Each will include two telescoping portions such as 58 and 60, preferably including sliding seals such as 62 and 64.

When the casing 20 is placed in the wellbore 12 and prior to placement of the cement 22 around the casing 20, steps should be taken to insure that the slip joints 55 and 57 are in a substantially collapsed position as shown in FIG. 6 so that there will be sufficient travel in the joints to allow the necessary movement of the casing. This can be accomplished by setting down weight on the casing 20 after it has been placed in the wellbore and before the cement 22 is placed or at least before the cement 22 has opportunity to set up.

Although two slip joints 55 and 57 are shown in FIG. 6 on opposite longitudinal sides of the openings 36, it will be appreciated that in many instances, a single slip joint will suffice to allow the necessary movement of the casing. It is preferred, however, to provide casing slip joints on both sides of the openings 36 to insure that any debonding of the cement 22 and casing 20 which may initiate adjacent the openings 36 will terminate when it reaches either of the slip joints 55 and 57 and will not propagate beyond the slip joints. This prevents any destruction of the cement/casing bond on a side of the slip joints longitudinally opposite the openings 36.

The formation of the fan-shaped slots 34 can be generally described as forming a cavity 34 in the formation 23 and thereby creating in the subsurface formation 23 adjacent the cavity 34 a localized least principal stress direction substantially parallel to the longitudinal axis 38 of the casing 20. Thus, the fracture such as 43 (see FIG. 4) will initiate in a plane generally perpendicular to the longitudinal axis 38.

It will be appreciated that the aspect of the present invention utilizing the casing slip joints may be used without the use of the fan-shaped slots described in FIGS. 1 and 2. The use of the fan-shaped slots is the preferred manner of initiating fractures in combination with the casing slip joints. Other means may be used, however, for initiating the fracture in the preferred direction, that is, in a plane radiating outward generally perpendicular to the longitudinal axis 38.

For example, FIG. 2A is a view similar to FIG. 2 which illustrates an alternative method of initiating the fracture in the preferred direction.

In FIG. 2A, a hydraulic jetting tool 100 has four jets 102, 104, 106 and 108 which are located in a common plane and spaced at 90° about the longitudinal axis of the tool 100. The jetting tool 100 may be located within the casing 20 and used to jet a first set of four radial bores or cavities 110, 112, 114 and 16. If more cavities are desired, the jetting tool 100 can then be rotated 45° to jet a second set of four radial bores 118, 120, 122 and 124.

Then when hydraulic fracturing fluid is applied under pressure to the radial bores 110–124, a fracture will tend to initiate generally in the plane containing the radial bores 110–124.

APPARATUS FOR FORMING FAN-SHAPED SLOTS

In FIG. 2, one form of apparatus 28 for forming the fan-shaped slots 34 is schematically illustrated. The apparatus 28 includes a housing 126 having a jet nozzle 128 on one side thereof. A positioning wheel 130 is carried by a telescoping member 132 which extends when the telescoping member 132 is filled with hydraulic fluid under pressure.

When the apparatus 28 is first located within the casing 20 at the desired location for creation of a fan-shaped slot, hydraulic pressure is applied to the apparatus 28 thus causing the telescoping member 132 to extend the positioning wheel 130 thus pushing the jet nozzle 128 up against the inside of the casing 20. Hydraulic fluid exiting the jet nozzle 128 will soon form the opening such as 36A in the casing 20. The tip of the jet nozzle 128 will enter the opening 36A. Then, the apparatus 28 may be pivoted back and forth through a slow sweeping motion of approximately 40° total movement. Using the opening 36A as the pivot point for the tip of the jet nozzle 128, this back-and-forth sweeping motion will form the fan-shaped slot 34A.

Figure 7:
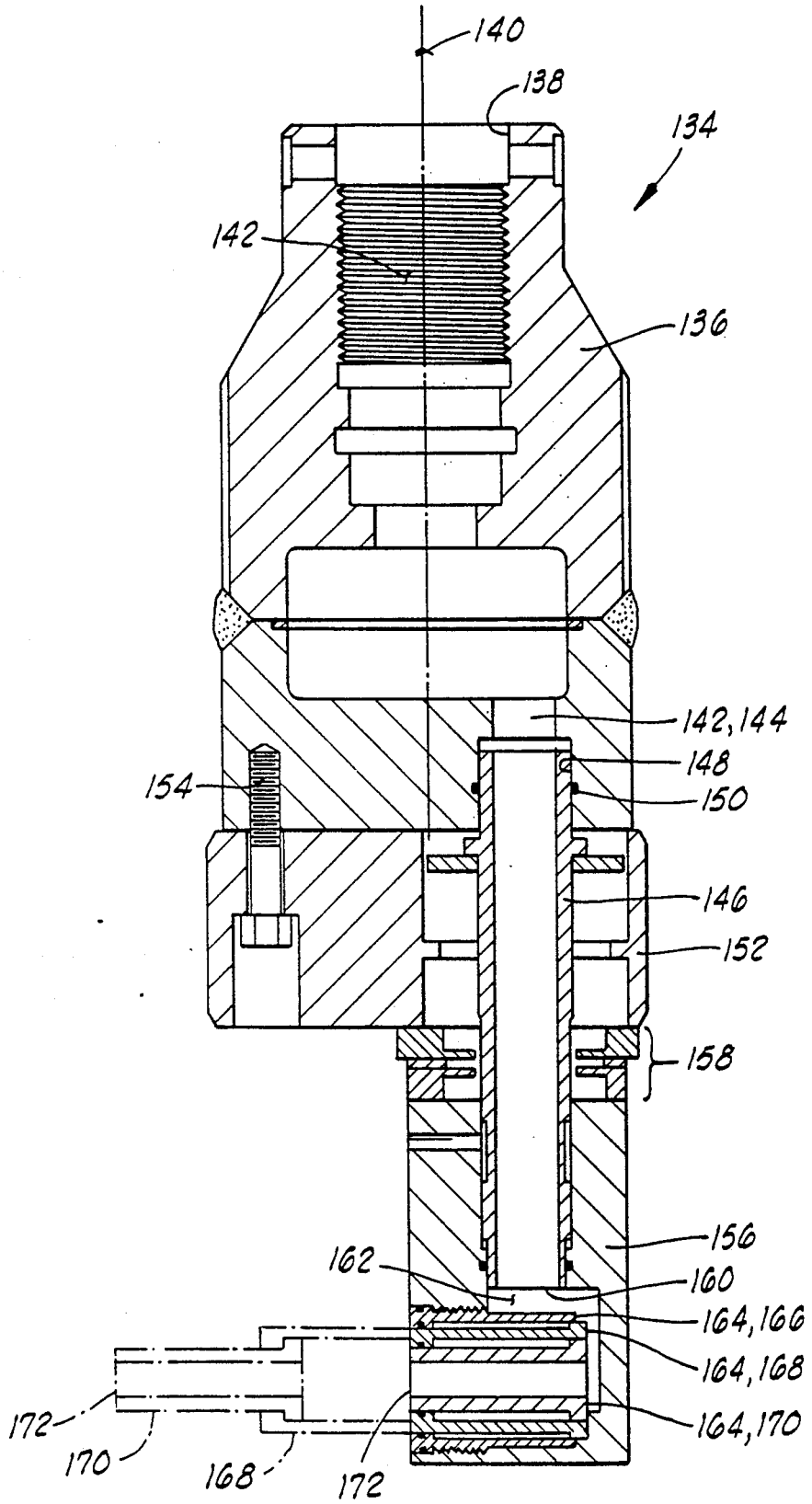
FIG. 7 is a sectioned elevation view of an alternative apparatus for cutting the fan-shaped slots.
Figure 9:
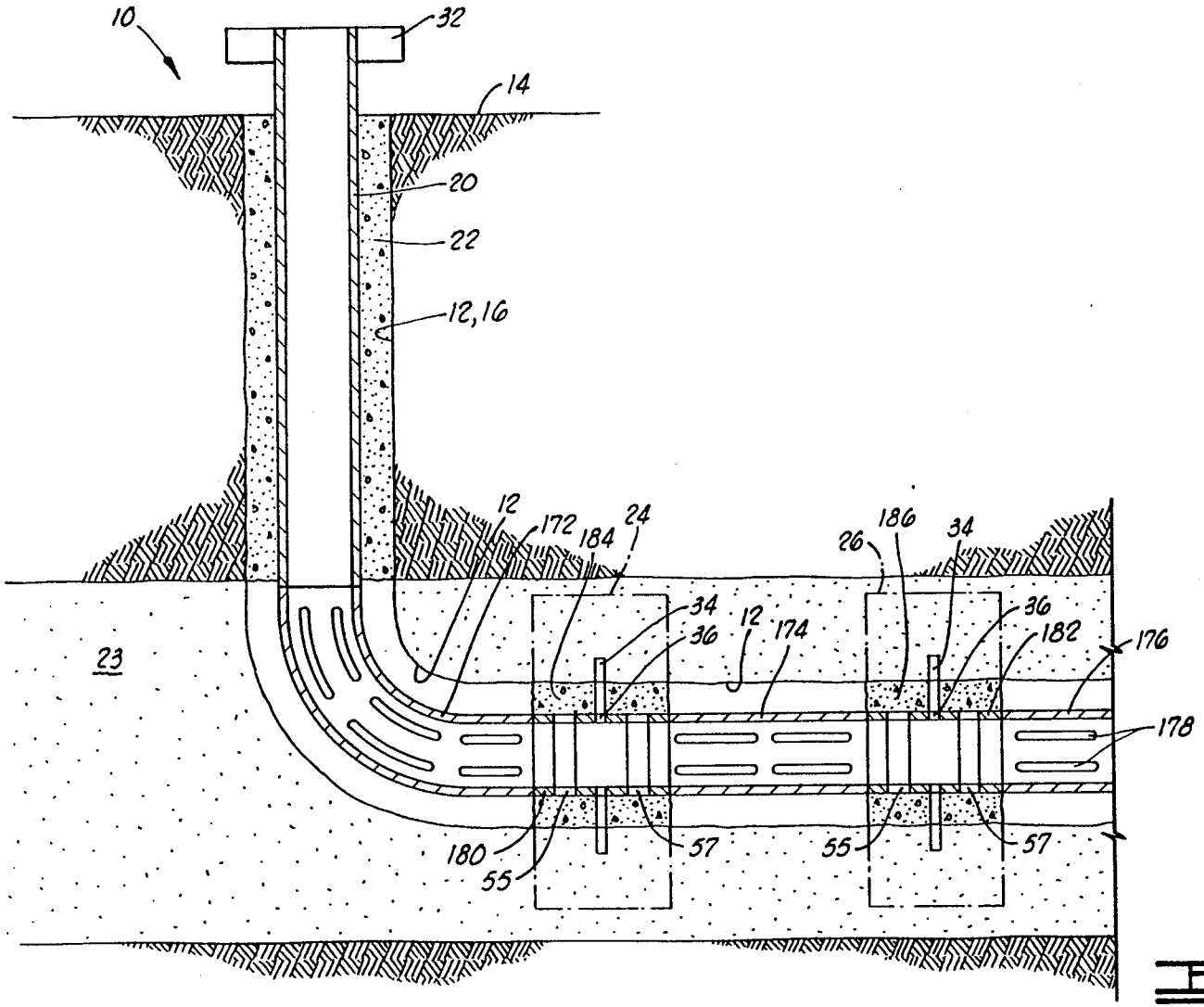

FIG. 7 illustrates an alternative embodiment of a hydraulic jetting tool for cutting the fan-shaped slots. The hydraulic jetting tool of FIG. 7 is generally designated by the numeral 134. The apparatus 134 includes a housing 136 having an upper end with an upper end opening 138 adapted to be connected to a conventional tubing string such as 30 (see FIG. 1) on which the apparatus 134 is lowered into the well. The tubing string 30 will preferably carry a centralizer (not shown) located a short distance above the upper end of the apparatus 134 so that the apparatus 134 will have its longitudinal axis 140 located generally centrally within the casing 20.

The housing 136 has an irregular passage 142 defined therethrough. The irregular passage 142 includes an eccentrically offset lower portion 144. A hollow shaft 146 has its upper end portion received within a bore 148 of eccentric passage portion 144 with an O-ring seal 150 being provided therebetween. An end cap 152 is attached to housing 136 by bolts such as 154 to hold the hollow shaft 146 in place relative to housing 136.

A nozzle holder 156 is concentrically received about the lower end portion of hollow shaft 146 and is rotatably mounted relative to end cap 152 by a swivel schematically illustrated and generally designated by the numeral 158. The hollow shaft 146 has an open lower end 160 communicated with a cavity 162 defined in the nozzle holder 156.

A laterally extendable telescoping nozzle 164 is also received in cavity 162. Telescoping nozzle 164 includes an outer portion 166, an intermediate portion 168, and an innermost portion 170.

When hydraulic fluid under pressure is provided to the cavity 162, the differential pressures acting on the innermost portion 170 and intermediate portion 168 of telescoping nozzle 164 will cause the innermost portion 170 to move to the left relative to intermediate portion 168, and will cause the intermediate portion 168 to extend to the left relative to outer portion 164, so that an open outer end 172 of the telescoping nozzle 164 will extend to the position shown in phantom lines in FIG. 7.

Thus, to use the apparatus 134 of FIG. 7, the apparatus is lowered into the well on the tubing string 30 until it is adjacent the location where it is desired to cut the fan-shaped slots. Then hydraulic fluid under pressure is provided through tubing string 30 to the apparatus 134 to cause the telescoping nozzle 164 to extend outward to the position shown in phantom lines in FIG. 7 wherein the open outer end 172 will be adjacent the inner wall of the casing 20. The hydraulic fluid exiting the open end 172 will soon create an opening 36 in the wall of casing 20 through which the outer end 172 of the inner nozzle portion 170 will extend. Then, the apparatus 134 is continuously rotated about its longitudinal axis 140 by rotating tubing string 30. The eccentric location of nozzle holder 156 will thus cause the nozzle 164 to pivot back and forth through an angle about the opening 36 which forms the pivot point for the outer end 172 of the telescoping nozzle 164. As the apparatus 134 rotates, the nozzle 164 will partially collapse and then extend so that open end 172 stays in opening 36.

After a first fan-shaped slot such as 34A has been formed, hydraulic pressure is released while the apparatus 134 is rotated through an angle of approximately 90°. Then hydraulic pressure is again applied and the telescoping nozzle 174 will again be pressed against the inner wall of casing 20 and the process is repeated to form another fan-shaped slot such as 34B.

THE EMBODIMENT OF FIG. 8

FIG. 8 is a view similar to FIG. 2 showing the use of certain aspects of the present invention in connection with a well wherein the horizontal portion of the well includes portions of slotted casing separated by portions of solid casing incorporating slip joints and utilizing the radial slotting techniques of the present invention.

In FIG. 8, the horizontal portion of the well includes first, second and third segments of slotted casing designated as 172, 174 and 176, respectively. Those segments of slotted casing are surrounding by open portions of the borehole 12 so that the borehole 12 freely communicates with the interior of the slotted casing through slots such as generally designated as 178. The borehole surrounding the slotted casing segments may be gravel packed.

Located between the segments of slotted casing are first and second segments of solid casing 180 and 182. Each segment of solid casing includes slip joints 55 and 57 such as previously described with regard to FIG. 6.

The wellbore adjacent each of the segments 180 and 182 of solid casing is spot-cemented as indicated at 184 and 186, respectively. The segments of solid casing are then communicated with the zones 24 and 26, respectively, through the use of the radial slotting techniques previously described wherein slots 34 and openings 36 ar formed through the solid casing at locations between the casing slip joints.

Then, a straddle packer (not shown) can be lowered on tubing string into the casing so as to fracture the zones of interest 24 and 26 individually through their fan-shaped slots 34. The casing slip joints 55 and 57 along with the fan-shaped slots 34 will cause the fractures to radiate outward into the zones 24 and 26 while the spot-cement 184 and 186 will still provide isolation between the zones 24 and 26.

Thus it is seen that the present invention readily achieves the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. A method of fracturing a subsurface formation of a well having a well casing cemented in a borehole intersecting said subsurface formation, comprising:
   (a) providing an opening through said casing communicating an interior of said casing with said subsurface formation;
   (b) providing at least a first slip joint in said casing;
   (c) communicating a fracturing fluid through said opening to said subsurface formation;
   (d) applying pressure to said fracturing fluid and through said opening to said subsurface formation;
   (e) initiating a fracture in said subsurface formation adjacent said opening;
   (f) during step (e), allowing said casing to move with said subsurface formation by means of said first slip joint; and
   (g) thereby preventing destruction of a bond between said casing and cement surrounding said casing during step (e).

2. The method of claim 1, wherein:
   in step (a), said opening is provided in a highly deviated portion of said well.

3. The method of claim 2, wherein:
   in step (a), said opening is provided in a substantially horizontal portion of said well.

4. The method of claim 1, wherein:
   step (b) includes providing a second slip joint in said casing, said first and second slip joints being on opposite longitudinal sides of said opening.

5. The method of claim 1, wherein:
   step (g) includes terminating any destruction of said bond at said slip joint and thereby preventing any destruction of said bond on a side of said slip joint longitudinally oppoiste said opening.

6. The method of claim 1, further comprising:
   forming through said opening a cavity in said formation and thereby creating in said subsurface formation adjacent said cavity a localized least principal stress direction substantially parallel to a longitudinal axis of said casing; and
   in step (e), initiating said fracture at said cavity in a plane generally perpendicular to said longitudinal axis.

7. The method of claim 6, wherein:
   said forming of said cavity includes forming a fan-shaped slot in said formation, said fan-shaped slot circumscribing a substantially larger arc about said axis than does the opening through which said slot was formed.

8. The method of clim 6, wherein:
   said forming of said cavity includes forming a plurality of radially extending holes in said formation, said holes lying generally in said plane perpendicular to said longitudinal axis.

9. A method of modifying a well having a casing intersecting a subsurface formation, comprising:
   (a) inserting a hydraulic jetting tool into said casing;
   (b) forming one or more openings through said casing; and (c) with said hydraulic jetting tool, directing a hydraulic jet through said one or more openings and cutting one or more fan-shaped slots in said subsurface formation in a plane transverse to a longitudinal axis of said casing, each of said fan-shaped slots circumscribing a substantially larger arc about said axis than does the opening through which said slot was cut.

10. The method of claim 9, wherein:

said plane is substantially perpendicular to said longitudinal axis of said cavity.

11. The method of claim 9, wherein:

in step (b), said openings in said casing are formed by said hydraulic jetting tool.

12. The method of claim 11, wherein:

each of said one or more openings defines a pivotal base for its associated fan-shaped slot.

13. The method of claim 12, wherein:

in step (c), said hydraulic jetting tool is pivoted within said casing about one of said openings as said hydraulic jet cuts one of said fan-shaped slots.

14. The method of claim 9, wherein:

each of said one or more openings defines a pivotal base for its associated fan-shaped slot.

15. The method of claim 14, wherein:

in step (c), said hydraulic jetting tool is pivoted within said casing about one of said openings as said hydraulic jet cuts one of said fan-shaped slots.

16. The method of claim 9, further comprising:

applying a high pressure fracturing fluid to said one or more fan-shaped slots; and initiating a fracture in said subsurface formation in a plane defined by said one or more fan-shaped slots.

17. The method of claim 16, wherein:

said longitudinal axis of said casing is deviated greater than 45° from a vertical direction.

18. The method of claim 9, wherein:

in step (c), said one or more fan-shaped slots create a localized least principal stress direction in said subsurface formation substantially parallel to said longitudinal axis of said casing thereby aiding subsequent fracture initiation in a plane generally perpendicular to said longitudinal axis.

19. A method of modifying a well having a casing intersecting a subsurface formation, comprising:

(a) providing an opening through said casing;

(b) forming through said opening an arcuate slot in said formation; and (c) maintaining a structural integrity of said casing during steps (a) and (b).

20. The method of claim 19, further comprising:

prior to step (b), inserting a hydraulic jetting tool into said casing; and in step (b), directing a hydraulic jet from said hydraulic jetting tool through said opening and cutting said arcuate slot with said hydraulic jet.

21. The method of claim 20, wherein:

in step (a), said opening is formed with said hydraulic jetting tool.

22. The method of claim 19, wherein:

said arcuate slot lies in a plane transverse to a longitudinal axis of said casing and circumscribes a substantially larger arc about said longitudinal axis than does said opening through which said slot was formed.

23. The method of claim 22, wherein:

said plane of said arcuate slot is substantially perpendicular to said longitudinal axis of said casing.

24. The method of claim 19, wherein:

said opening defines a pivotal base of said arcuate slot.

25. The method of claim 24, wherein:

both said opening and said arcuate slot are cut with a hydraulic jet from a hydraulic jetting tool located within said casing.

26. A method of fracturing a subsurface formation of a well having a well casing cemented in a borehole intersecting said subsurface formation, comprising:

(a) providing an opening through said casing;

(b) forming a fan-shaped slot in said formation, said slot being communicated with said opening, and thereby creating a localized least principal stress axis in said formation generally perpendicular to a plane of said fan-shaped slot;

(c) during steps (a) and (b), maintaining a structural integrity of said casing;

(d) communicating a fracturing fluid through said opening to said fan-shaped slot;

(e) applying pressure to said fracturing fluid and to said fan-shaped slot; and (f) initiating a fracture in said formation generally co-planar with said fan-shaped slot.

27. The method of claim 26, said well being a highly deviated well wherein:

in step (b), said plane of said fan-shaped slot is substantially perpendicular to a longitudinal axis of said well casing; and in step (f), said fracture is initiated in a direction substantially perpendicular to said longitudinal axis of said well casing.

28. The method of claim 27, further comprising:

providing first and second casing slip joints in said casing on opposite longitudinal sides of said opening;

during step (f), allowing said casing to move with said formation; and thereby preventing destruction of a bond between said casing and cement surrounding said casing during step (f).

29. The method of claim 26, further comprising:

prior to step (a), placing a hydraulic jetting tool in said casing;

in steps (a) and (b), cutting said opening and said fan-shaped slot with said hydraulic jetting tool.

30. The method of claim 29, wherein:

in step (b), said hydraulic jetting tool is pivoted about said opening so that said fan-shaped slot circumscribes a greater arc about a longitudinal axis of said casing than does said opening.

31. The method of claim 30, wherein:

said plane of said fan-shaped slot is substantially perpendicular to said longitudinal axis of said casing.

32. The method of claim 31, further comprising:

cutting at least one additional opening and fan-shaped slot circumferentially spaced about said casing from said first mentioned opening and generally co-planar with said first mentioned slot.

* * * * *